US010760278B2

(12) United States Patent
Gonzalez et al.

(10) Patent No.: US 10,760,278 B2
(45) Date of Patent: Sep. 1, 2020

(54) HIGH-STRENGTH WIND LOAD-RESISTANT LIGHTWEIGHT CEMENTITIOUS SOFFIT ASSEMBLY

(71) Applicant: James Hardie Technology Limited, Dublin (IE)

(72) Inventors: Jose Gonzalez, San Bernardino, CA (US); Benjamin Batres, Fontana, CA (US); Chad Diercks, Yucaipa, CA (US); Alireza Mohebbi, Corona, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 16/363,147

(22) Filed: Mar. 25, 2019

(65) Prior Publication Data

US 2019/0301165 A1 Oct. 3, 2019

Related U.S. Application Data

(60) Provisional application No. 62/648,683, filed on Mar. 27, 2018.

(51) Int. Cl.
*E04D 13/152* (2006.01)
*E04D 13/17* (2006.01)
*E04D 13/158* (2006.01)

(52) U.S. Cl.
CPC ..... *E04D 13/152* (2013.01); *E04D 13/158* (2013.01); *E04D 13/178* (2013.01)

(58) Field of Classification Search
CPC ... E04D 13/152; E04D 13/158; E04D 13/178; F24F 13/082
See application file for complete search history.

(56) References Cited

U.S. PATENT DOCUMENTS 4,957,037 A * 9/1990 Tubbesing ..... E04D 13/174 454/366
5,718,086 A * 2/1998 Dunn ..... E04D 13/152 454/260
6,705,052 B1 * 3/2004 Larson ..... E04D 13/178 52/302.1
2003/0097810 A1 * 5/2003 Leichtfried ..... E04F 13/08 52/518
2007/0204528 A1 * 9/2007 Shugart ..... E04D 13/152 52/90.1

(Continued)

*Primary Examiner* — Christine T Cajilig
(74) *Attorney, Agent, or Firm* — Knobbe Martens Olson & Bear, LLP

(57) ABSTRACT

A fiber cement soffit comprising a first major face, a second major face, an intermediate portion positioned between the first and second faces and an edge portion surrounding the intermediate portion such that the first and second faces, intermediate portion and edge portion together form a panel of predetermined thickness; and a plurality of apertures extending between the first and second major faces of the soffit through the predetermined thickness forming a vented portion wherein the apertures comprise between approximately 8% and 28% of the total surface area per linear foot of each of the first major face and second major face of the vented portion such that the net free ventilation provided per linear foot of the fiber cement soffit is between 10 and 16 square inches.

17 Claims, 18 Drawing Sheets

(56) References Cited

U.S. PATENT DOCUMENTS

| | | | | |
|---|---|---|---|---|
| 2010/0251632 | A1* | 10/2010 | Chen | B28B 3/26 52/95 |
| 2013/0074428 | A1* | 3/2013 | Allen | E04D 13/17 52/173.3 |
| 2013/0167833 | A1* | 7/2013 | Daniels | F24F 5/0096 126/621 |
| 2017/0016634 | A1* | 1/2017 | Lee | F24F 1/0014 |

* cited by examiner

HIGH-STRENGTH WIND LOAD-RESISTANT LIGHTWEIGHT CEMENTITIOUS SOFFIT ASSEMBLY

CROSS-REFERENCE TO RELATED APPLICATIONS

This Any and all applications for which a foreign or domestic priority claim is identified in the Application Data Sheet as filed with the present application are hereby incorporated by reference under 37 CFR 1.57.

BACKGROUND

Field

The present disclosure generally relates to fiber cement building construction materials and methods of installation of the same.

Description of the Related Art

Soffits are typically installed on a building structure to connect the roof overhang and the side of the building. Various materials, such as wood or metal, can be used as soffits. Soffits disposed between the exterior of a building and an interior space, such as an attic space, may experience high wind load conditions, for example, due to storms or the like. In such instances, soffit failure can occur if the soffit elements do not have sufficient wind load resistance. It may be desirable to provide soffit panels that combine a pleasing aesthetic appearance with high wind load resistance and/or flexural strength (e.g., modulus of rupture).

Any discussion of the prior art throughout the specification should in no way be considered as an admission that such prior art is widely known of forms part of the common general knowledge in the field.

SUMMARY

In a first embodiment, a soffit assembly for a building structure with an attic space comprises a fiber cement soffit panel configured to couple to an underside of an eave framing structure extending outward relative to the building structure and comprising a plurality of framing members defining any airflow path in fluid communication with the attic space. The fiber cement soffit panel comprises a substantially planar first major face, a substantially planar second major face, an intermediate portion positioned between the first and second major faces, and a plurality of integrally formed cylindrical apertures extending through the intermediate portion from the first major face to the second major face to permit airflow between an exterior volume and the airflow path. Each of the cylindrical apertures has an obround cross section defined by a first axis and a second axis perpendicular to the first axis, the second axis being longer than the first axis and oriented at an angle of between approximately 25° and approximately 40° relative to a machine direction of the fiber cement soffit panel such that opposing ends of the cylindrical apertures are offset from each other, the apertures being arranged in a grid pattern generally defining a ventilated area of the fiber cement soffit panel, the cylindrical apertures comprising between approximately 9% and approximately 15.5% of the total surface area of the ventilated area, wherein the fiber cement soffit panel further comprises one or more non-ventilated fastening areas disposed along an edge of the fiber cement soffit panel, and wherein a plurality of mechanical fasteners extend through one of the one or more fastening areas and into one of the plurality of framing members to fix the fiber cement soffit panel to the eave framing structure. The composition of the fiber cement soffit panel comprises between 50 wt % and 68 wt % silica, between 24 wt % and 36 wt % cement, between 6 wt % and 9 wt % cellulose fibers, and between 2 wt % and 5 wt % alumina, and the fiber cement soffit panel has a net free ventilation between 10 and 16 square inches per linear foot and maintains an average modulus of rupture per linear foot of between approximately 6.4 MPa and 8.2 MPa.

In another embodiment, there is provided in various embodiments a vented fiber cement article comprising:

a panel comprising a first major face, a second major face and an intermediate portion positioned between the first and second faces such that the first face, second face and intermediate portion together form the panel; and a plurality of apertures extending between the first and second major faces of the panel through the intermediate portion such that a vented portion is formed in the panel;

wherein the surface area of the plurality of apertures comprises between approximately 9% and 15.5% of the total surface area of the vented portion per linear foot such that the net free ventilation of the vented fiber cement article is between 10 and 16 square inches per linear foot.

In one embodiment, each aperture is configured to act as an air inlet which allows cool air to be drawn in to the attic space when in use as a soffit material lining the underside of eaves. The net free ventilation figure is used to calculate how many feet of the vented fiber cement article is required to line the underside of eaves based on the calculated Net Free Area (NFA) to achieve a balanced ventilation system for a particular roof system.

In one embodiment, each aperture is cylindrical aperture. In one example, each cylindrical aperture comprises an obround shape in cross section wherein the obround shape comprises two semicircles connected to each other by parallel lines tangent to their endpoints. The obround cylindrical aperture comprises at least a first axis and a second axis, wherein the first and second axis are perpendicular to each other in the same plane and the length of the first axis of the obround cylindrical aperture is smaller than the length of the second axis of the obround cylindrical aperture.

In one embodiment, the first axis of each aperture of the vented fiber cement article is between approximately 0.17" (0.43 cm) and 0.19" (0.48 cm)±10% in length. In one embodiment the second axis of each aperture of the vented fiber cement article is between approximately 0.73" (1.85 cm) and 0.85" (2.16 cm)±10% in length. In one embodiment the first axis of the obround cylindrical aperture corresponds to the width of the obround cylindrical aperture and the second axis of the obround cylindrical aperture corresponds to the length of the obround cylindrical aperture. In a further embodiment, the surface area of each aperture of the vented fiber cement article is between approximately 0.118 and 0.215 inches squared (0.76 $cm^2$ and 1.39 $cm^2$).

In a further embodiment, each aperture is configured to be a circular cylindrical aperture wherein the length of the first axis of the aperture is equal to the length of the second axis of the aperture.

In an alternative embodiment, the plurality of apertures comprises a combination of circular cylindrical apertures and obround cylindrical apertures.

In one embodiment, the plurality of apertures of the vented portion are provided in a series of columns and rows such that a grid pattern is formed, wherein the rows of apertures are perpendicular to the columns of apertures within the grid pattern. In a further embodiment, each of the columns and rows are provided in-line with each other within the grid pattern. In an alternative embodiment, the columns and rows are provided offset from each other within the grid pattern. In a further embodiment, the series of rows and columns extend in a continuous manner within the grid pattern. In an alternative embodiment, the series of rows and columns extend in an interrupted manner such that the grid pattern comprises a repeating pattern, whereby non-vented portions are positioned intermediate adjacent groupings of apertures in rows and columns within the grid pattern. In various exemplary embodiments, the number of rows in the grid pattern is between 6 and 11 and the number of columns per linear foot of the grid pattern is between 6 and 12.

In one embodiment, the distance between the first and last row of apertures within a series of rows of the grid pattern is between approximately 4.68" (11.89 cm) and 5.68" (14.43 cm). In a further embodiment, it is desirable to provide a fastening area which extends from the outermost tips of the first and last apertures in the series of rows and columns within the grid pattern. The fastening area allows placement of fasteners in the vented fiber cement article to secure the vented fiber cement article in a desired position when in use. In one embodiment, the fastening area comprises approximately 1.5" (3.81 cm) which extends from the outermost tips of the first and last apertures in the series of rows and columns within the grid pattern. In such an embodiment the vented portion extends between approximately 7.68" (19.51 cm) and 8.68" (22.05 cm) in a planar direction perpendicular to the direction of the series of columns in the grid pattern. Accordingly, in this embodiment, the total surface area of the vented portion per linear foot is between approximately 92 and 104 inches squared (0.059 $m^2$ and 0.067 $m^2$).

In a further various embodiments, the vented portion is configured such that the plurality of apertures in the vented portion comprises between approximately 60 and 132 apertures per linear foot. Accordingly, in such embodiments wherein the total surface area of the vented portion per linear foot is between approximately 92 and 104 inches squared (0.059 $m^2$ and 0.067 $m^2$), the plurality of apertures comprises between 9% and 15.5% of the total surface area per linear foot of the vented portion.

In one exemplary embodiment, the vented portion is configured such that the plurality of apertures comprises between approximately 95 and 108 apertures per linear foot. In such an embodiment the plurality of apertures comprises between approximately 12% and 12.5% the total surface area per linear foot.

In a further embodiment, each obround cylindrical aperture within the grid pattern is orientated such that the second axis of an obround cylindrical aperture within each column is positioned at an angle relative to the perpendicular axes of each column and row within the grid pattern. In one embodiment, the angle of the second axis of each obround cylindrical aperture relative to the perpendicular axes of each column and row within the grid pattern is between 0° and 180°. In a further embodiment, the angle of the second axis of each obround cylindrical aperture relative to the perpendicular axes of each column and row within the grid pattern is between 0° and 90°±5°. In a further embodiment, the angle of the second axis of each obround cylindrical aperture relative perpendicular axes of each column and row within the grid pattern is between 0° and 45°±5°. In one embodiment, the angle of the second axis of each obround cylindrical aperture relative perpendicular axes of each column and row within the grid pattern is approximately 33°±5°.

In one embodiment of the vented fiber cement article wherein the net free ventilation of the vented fiber cement article is between 10 and 16 sq. inches per linear foot, the average Modulus of Rupture (MOR) per linear foot is between approximately 6.4 MPa to 8.2 MPa. Accordingly, the configuration of the apertures within the vented fiber cement article as described herein may advantageously achieve an improved net free ventilation while retaining the structural integrity of the fiber cement article.

In certain exemplary embodiments, the vented fiber cement article is an elongate rectangular panel comprises one or more various widths extending between approximately 12" (30.48 cm) and 24" (50.8 cm) and one or more lengths extending between for example 8 feet (2.4 m) and 16 feet (4.9 m).

In one embodiment, the first and second major faces are opposing faces of the vented fiber cement article. In a further embodiment, the intermediate portion and edge portion are integrally formed with the first and second major faces of the vented fiber cement article.

For the purposes of this specification, the term 'comprise' shall have an inclusive meaning. Thus it is understood that it should be taken to mean an inclusion of not only the listed components it directly references, but also non specified components. Accordingly, the term 'comprise' is to be attributable with as broad an interpretation as possible and this rationale should also be used when the terms 'comprised' and/or 'comprising' are used.

Further aspects or embodiments of the present disclosure will become apparent from the ensuing description which is given by way of example only.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION OF THE PREFERRED EMBODIMENTS

Figure 1A:
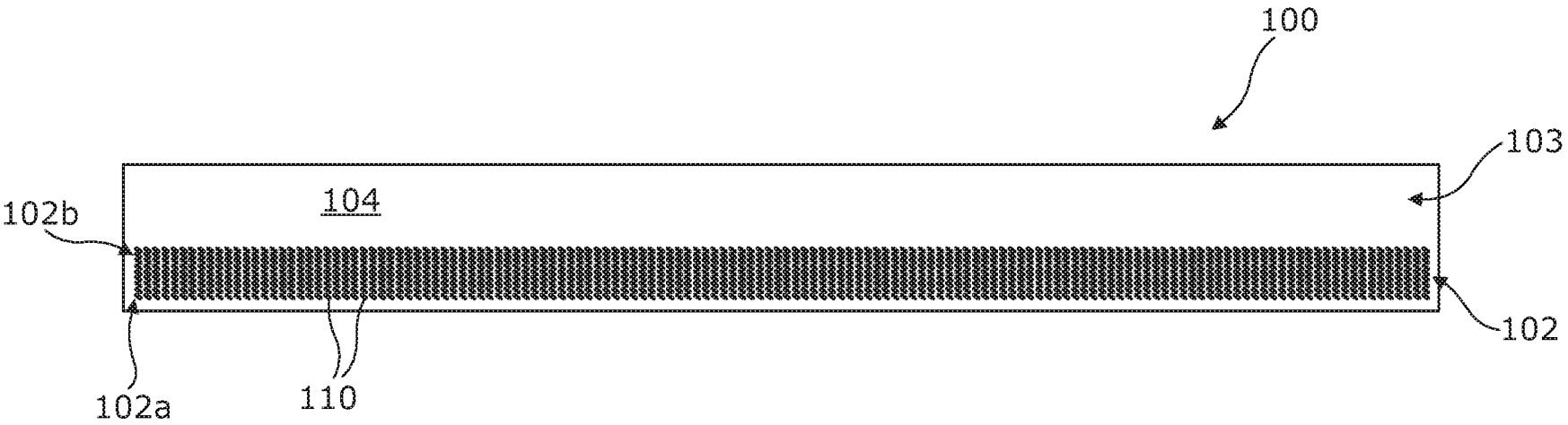
FIG. 1A is a top view of an example embodiment of a vented fiber cement article.

In the description which follow, like parts may be marked throughout the specification and drawings with the same reference numerals. The drawing figures are not necessarily to scale and certain features may be shown exaggerated in scale or in somewhat generalized or schematic form in the interest of clarity and conciseness.

Generally described, the present disclosure provides high-strength wind load-resistant fiber cement articles that may include provide improved structural strength, flexibility and aesthetic features relative to certain other fiber cement articles. The disclosed fiber cement articles may further provide for soffit ventilation without undesirably sacrificing flexural strength or wind load resistance. As will be described in greater detail below, the novel combinations of fiber cement compositions, sizes, aperture configurations (e.g., size, shape, spacing, location, orientation, etc.), yield desirable improvements in strength and wind load resistance while also providing reduced weight and enhanced ventilation functionality. It was conventionally understood that manufacturing a fiber cement soffit panel with a ventilated area including a plurality of apertures would significantly weaken the panel, and that a concentration of apertures occupying, for example, 9% or more of the surface area of the ventilated area would yield a fiber cement panel too weak to serve as a soffit panel. However, it has been discovered that the configurations described herein, including obround apertures disposed in a particular grid pattern with each obround aperture disposed at an angle across the composite layers and across the machine direction of the fiber cement, unexpectedly results in a fiber cement article that has desirable flexural strength (e.g., an average modulus of rupture per linear foot between approximately 6.4 MPa and 8.2 MPa), while including a ventilated area in which more than 9% of the surface area is occupied by the apertures.

In some instances, it may be desirable to install fiber cement articles, such as soffit panels, without needing to separately install ventilation elements, as the additional installation of ventilation elements may be time-consuming, may increase the difficulty of an installation, and may ultimately detract from the aesthetic appearance of a building exterior due to the presence of ventilation panels that may differ in material, texture, or color relative to the surrounding fiber cement articles. Various embodiments described herein include a plurality of apertures through the panel configured to allow ventilation therethrough. It was previously understood that including ventilation features integrally formed within a fiber cement article would undesirably weaken the articles. However, as demonstrated by the testing data disclosed herein, it has been discovered that the novel sizes, shapes, arrangements, spacings, angles, and other aspects of the apertures described herein may allow for enhanced ventilation, while still retaining a desirable structural strength and flexibility when applied to fiber cement articles.

Referring now to the drawings and specifically FIGS. 1A to 1D, there is shown a first vented fiber cement article 100 in accordance with an example embodiment. Vented fiber cement article 100 comprises a first major face 104 and a second major face 106 opposing first major face 104. An intermediate portion (not shown) is positioned between the first and second faces together with an edge portion 108 surrounding the intermediate portion such that the first and second major faces 104, 106, intermediate portion and edge portion 108 together form a panel of predetermined thickness. In one embodiment, the intermediate portion and edge portion 108 are integrally formed with the first and second major faces 104, 106 of the vented fiber cement article to form a solid panel. Vented fiber cement article 100 further comprises a vented portion 102 and a non-vented portion 103. Vented portion 102 comprises a plurality of apertures 110 extending from the first major face 104 to the second major face 106 of the panel through the intermediate portion.

Figure 1B:
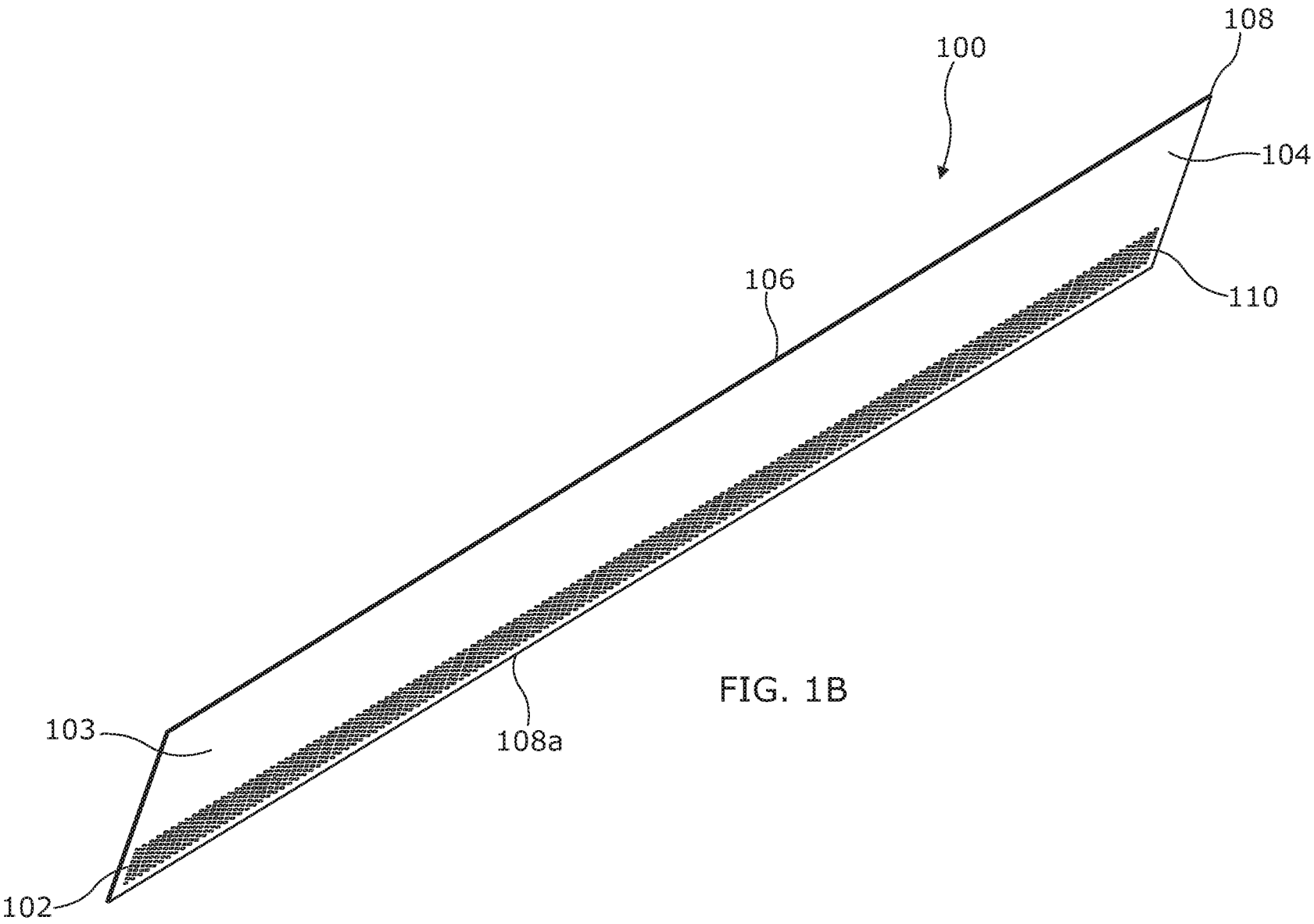
FIG. 1B is a perspective view of the vented fiber cement article of FIG. 1A.

Each aperture 110 is open ended and is configured to allow air to move between the first major face 104 and the second major face 106 through the vented fiber cement article 100. In use, this allows each aperture 110 to act as an air inlet. In particular, when vented fiber cement article 100 is being used as a soffit material lining the underside of eaves, apertures 110 enable a natural flow of air through an attic space as cool air is drawn in through each aperture 110 into the attic space as a result of hotter air rising and exiting the attic space through the roof. One advantage of certain embodiments of the vented fiber cement article is that the vented fiber cement article is capable of providing a net free ventilation of, for example, between 10 and 16 square inches per linear foot. As used herein, a linear foot corresponds to a measurement along a lengthwise axis of a vented fiber cement article (e.g., parallel to edge 108*a* as shown in FIG. 1B).

In this example embodiment, the plurality of apertures 110 are provided as a continuous pattern in a series of columns 102*a* and rows 102*b* providing a grid pattern in vented portion 102. The grid pattern comprises a series of nine rows 102*b* and twelve columns 102*a*. Each of the columns 102*a* and rows 102*b* are provided in-line with each other to form the grid pattern.

In other exemplary embodiments, the number of columns 102*a* and rows 102*b* in each respective grid pattern may be selected in accordance with any desired and/or required Net Free Ventilation (NFV) per linear foot. For example, in certain embodiments, the number of rows 102*b* in a grid pattern could range between six and eleven while the number of columns 102*a* in a grid pattern could range between six and twelve per linear foot. In certain non-limiting example embodiments, the distance 102*c* between the near-most tip of an aperture 111 in the first row of the grid pattern to the furthermost tip of an aperture 112 in the last row of the grid pattern is between approximately 4.68" (11.89 cm) and 5.68" (14.43 cm). A fastening area 105 extends from the outermost tips of the first and last apertures 111 and 112 in the series of rows and columns within the grid pattern to allow placement of fasteners in the vented fiber cement article to secure the vented fiber cement article in a desired position when in use. For example, the fastening area 105 may comprise a section of the vented fiber cement article 100 without apertures 110 or with a larger area between apertures to facilitate the placement of mechanical fasteners through the vented fiber cement article 100 at a desired location and/or spacing. In the exemplary embodiment shown, the fastening area 105 extends approximately 1.5" (3.81 cm) from the outermost tip of aperture 112 to the edge of the vented fiber cement article 100.

Figure 1C:
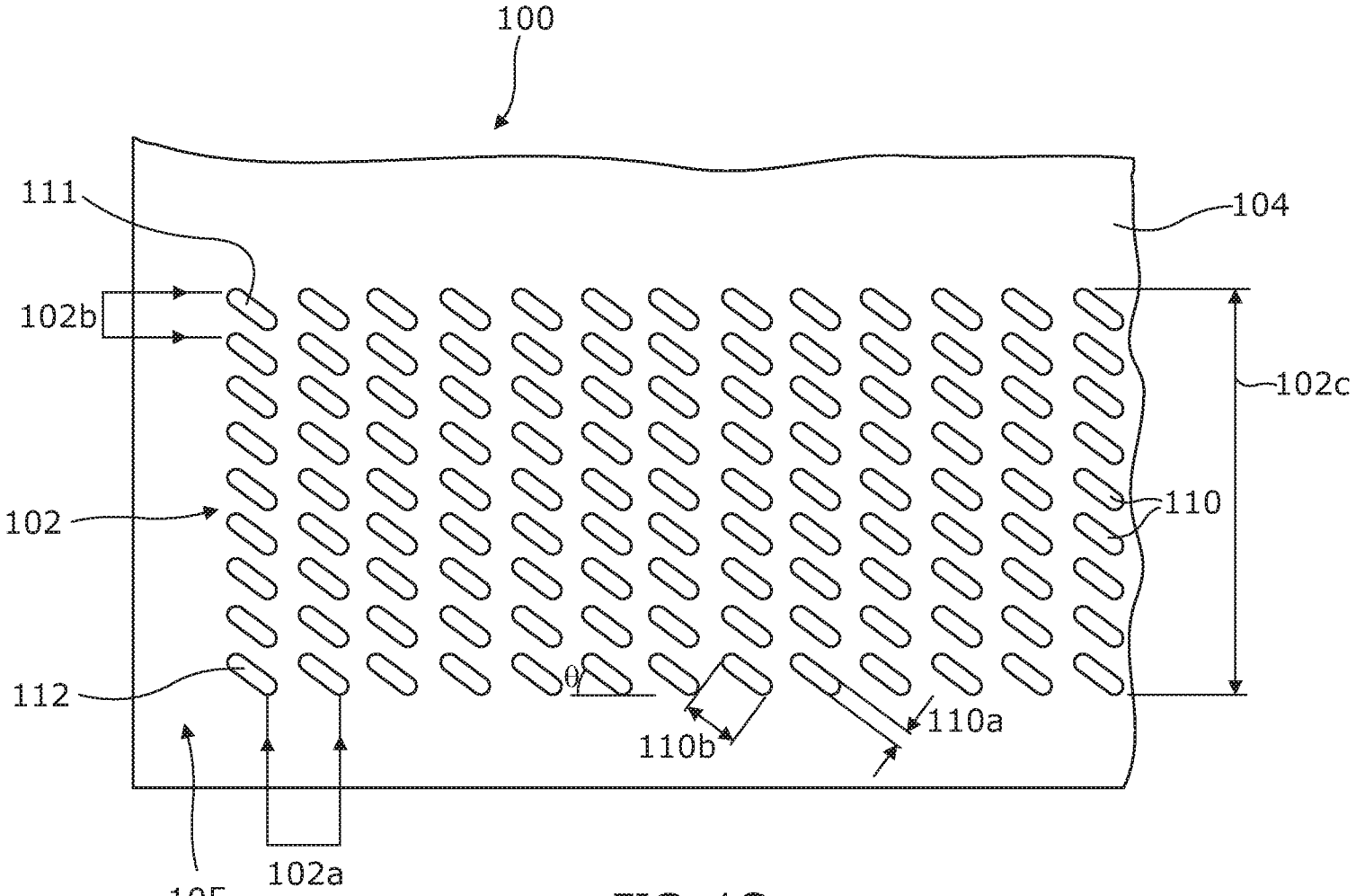
FIG. 1C is an enlarged view of the aperture pattern of the vented fiber cement article of FIG. 1A.

Referring specifically to FIG. 1C, in this example embodiment, each aperture 110 is in the form of an obround cylindrical aperture, wherein the obround cylindrical aperture has a first axis 110*a* and a second axis 110*b*. First axis 110*a* corresponds to the width of each aperture 110 and second axis 110*b* corresponds to the length of each aperture 110. First and second axis 110*a* and 110*b* are perpendicular to each other in the same plane. In the non-limiting example embodiment shown, the length of the first axis of each aperture of the vented fiber cement article is approximately 0.19" (0.48 cm)±10% and the length of the second axis of each aperture of the vented fiber cement article is approximately 0.776" (1.97 cm)±10%.

As will be discussed in greater detail below, FIGS. 2A to 4C depict further example embodiments of the vented fiber cement article in which the length of the first and second axes of the plurality of apertures is different to that of the example embodiment of FIGS. 1A to 1F. For example, in certain example embodiments, the first axis of each aperture of the vented fiber cement article can be between approximately 0.17" (0.43 cm) and 0.19" (0.48 cm)±10% and the second axis of each aperture of the vented fiber cement article can be between approximately 0.73" (1.85 cm) and 0.85" (2.16 cm)±10%.

Each of apertures 110 in the grid pattern are arranged such that the second axis 110*b* of each aperture is positioned at an angle θ relative to the perpendicular axes of each column and row or the longitudinal axis of the vented fiber cement article 100. In some embodiments, the longitudinal axis of the vented fiber cement article 100 may be parallel or substantially parallel to the machine direction of the fiber cement, and perpendicular to the cross-machine direction. In the non-limiting example embodiment shown, the angle θ of the second axis 110*b* relative to the longitudinal axis of the vented fiber cement article is approximately 33°±5°. As further demonstrated by the modulus of rupture (MOR) testing results disclosed herein, the strength of the fiber cement article 100 may be significantly improved by configuring the apertures as obround cylindrical apertures with the longer second axis of each aperture at an angle relative to the machine direction of the fiber cement. It has been discovered that an angle θ between approximately 25° and approximately 40°, such as about 33°, relative to the machine direction of the fiber cement, results in unexpectedly high flexural strength of the fiber cement article. This advantageous flexural strength is observed when these aperture configurations are implemented in a fiber cement material having a thickness between approximately 0.21 inches (5.5 mm) and approximately 0.75 inches (19.1 mm), and comprising between approximately 50 wt % and approximately 68 wt % of silica, between approximately 24 wt % and approximately 36 wt % of cement, between approximately 6 wt % and 9 wt % of cellulose fibers, and between approximately 2 wt % and approximately 5 wt % of alumina.

In certain other example embodiments, the angle θ of the second axis of each aperture relative to the longitudinal axis of the vented fiber cement article is between 0° and 180°. In a further embodiment, the angle of the second axis of each aperture relative to the longitudinal axis of the vented fiber cement article is between 0° and 90°±5°. In a further embodiment, angle of the second axis of each aperture relative to the longitudinal axis of the vented fiber cement article is between 0° and 45°±5°. In various embodiments, the angle θ can be, for example, between 15° and 45°, between 25° and 40°, between 30° and 35°, or another suitable angle. In some embodiments, an individual vented article may include rows or columns having a different angle θ relative to other rows or columns of the article.

Figure 1D:
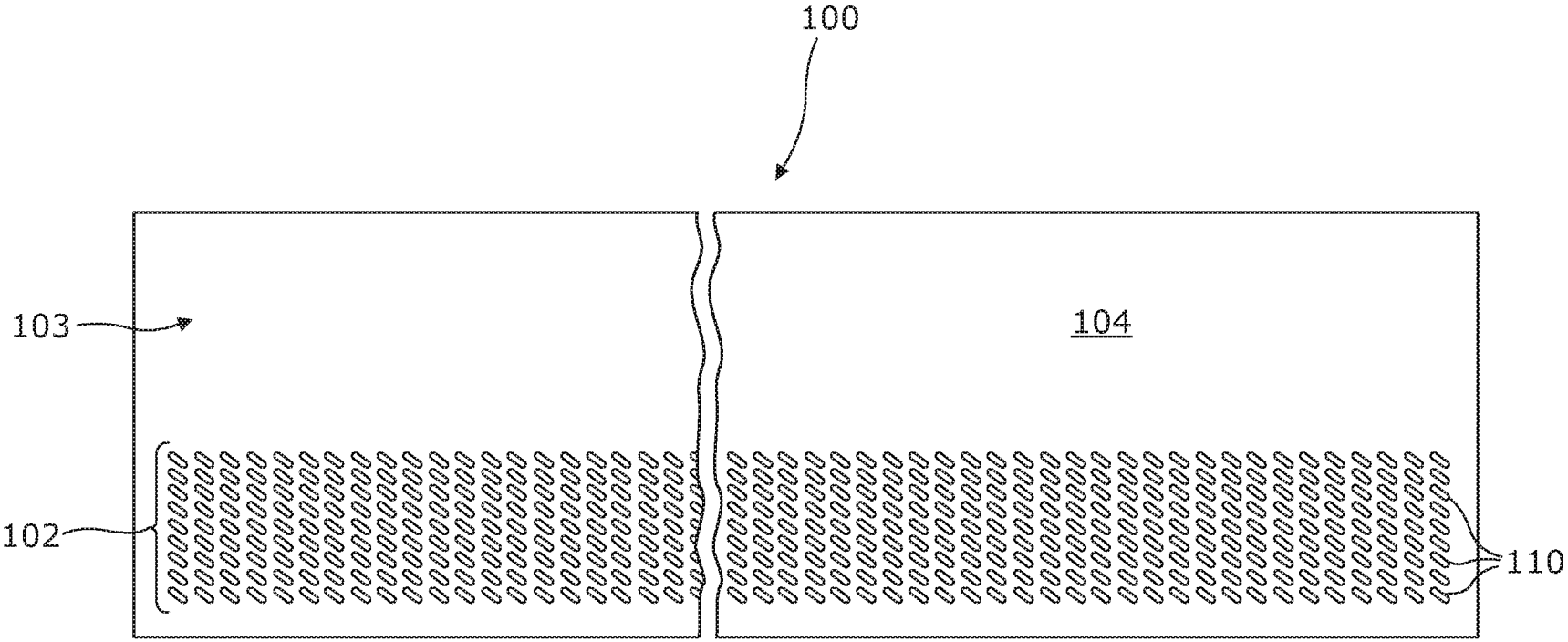
FIG. 1D is an enlarged top view of the aperture pattern of the vented fiber cement article of FIG. 1A.

When the example embodiment of vented fiber cement article 100 is used on the underside of eaves as soffit material, it may be preferred to provide the vented fiber cement article 100 in long lengths for example between 8 ft (2.4 m) and 16 ft (4.9 m) long. Additional lengths, such as 4 ft (1.2 m) or shorter, 12 ft (3.7 m), 20 ft (6.1 m) or longer, or any intermediate length therebetween, may also be provided. Referring now to FIG. 1D, there is shown an enlarged top view of the aperture pattern of the vented fiber cement article of FIG. 1A. In one embodiment, the grid pattern of vented portion 102 could be applied to vented fiber cement article 100 such that vented fiber cement article 100 forms, for example, either an 8 ft (2.4 m) or 12 ft (3.7 m) long vented soffit panel. It is also possible, in such an embodiment, that the predetermined thickness of the example vented fiber cement article 100 is approximately 0.25" (0.635 cm) and the width of the example vented fiber cement article 100 is preferably approximately 6" (15.24 cm) wide. In further example embodiments, it is possible for the vented fiber cement article 100 to vary between 12" and 24" (30.48 cm and 60.96 cm) in width.

In the example vented fiber cement article 100 shown, the plurality of apertures 110 comprises approximately 108 apertures per linear foot, thus the total number of apertures 110 may be between approximately 864 and 1728 when the vented fiber cement article 100 is 8 ft (2.4 m) and 16 ft (4.9 m) long respectively. Conveniently the net free ventilation achieved for this example embodiment may be approximately 15 square inches per linear foot. When the plurality of apertures comprises approximately 108 apertures per linear foot the plurality of apertures comprises approximately 14.48% of the total surface area of the vented portion per linear foot. The grid pattern is preferably located on the vented fiber cement article 100 such that the grid pattern is located adjacent one longitudinal edge. The remaining area of vented fiber cement article 100 corresponds to a non-vented portion 103. Locating the grid pattern on the vented fiber cement article 100 in this way may increase or maximize air flow through apertures 110 when the vented fiber cement article 100 is positioned under the eaves in use.

Figure 1E:
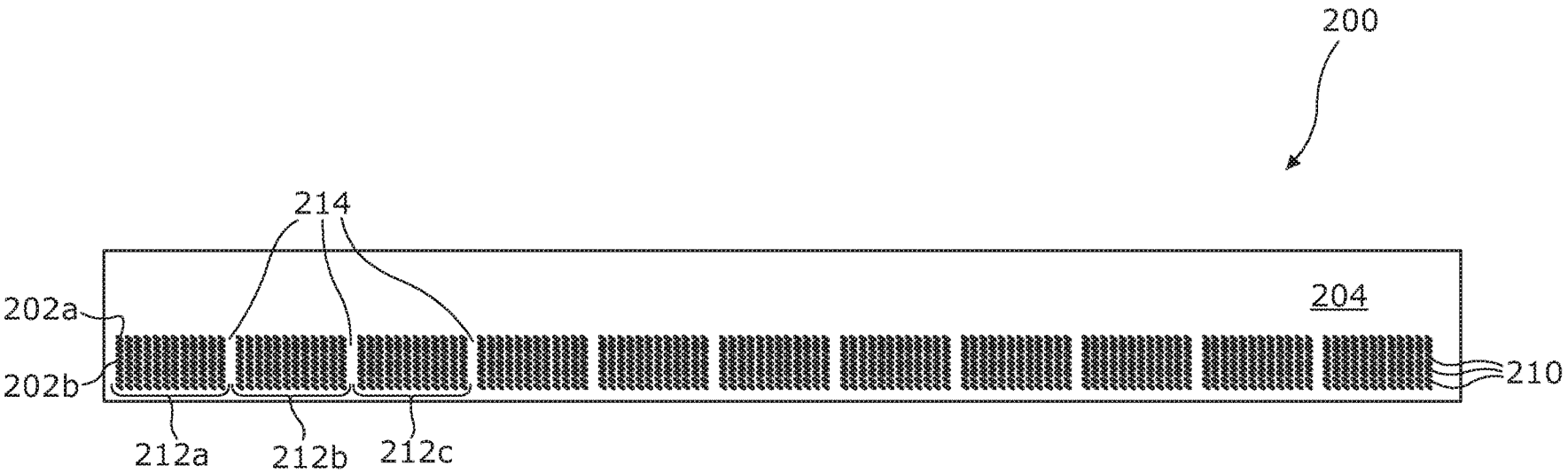
FIG. 1E is a top view of an alternative example embodiment of the vented fiber cement article of FIG. 1A.
Figure 1F:
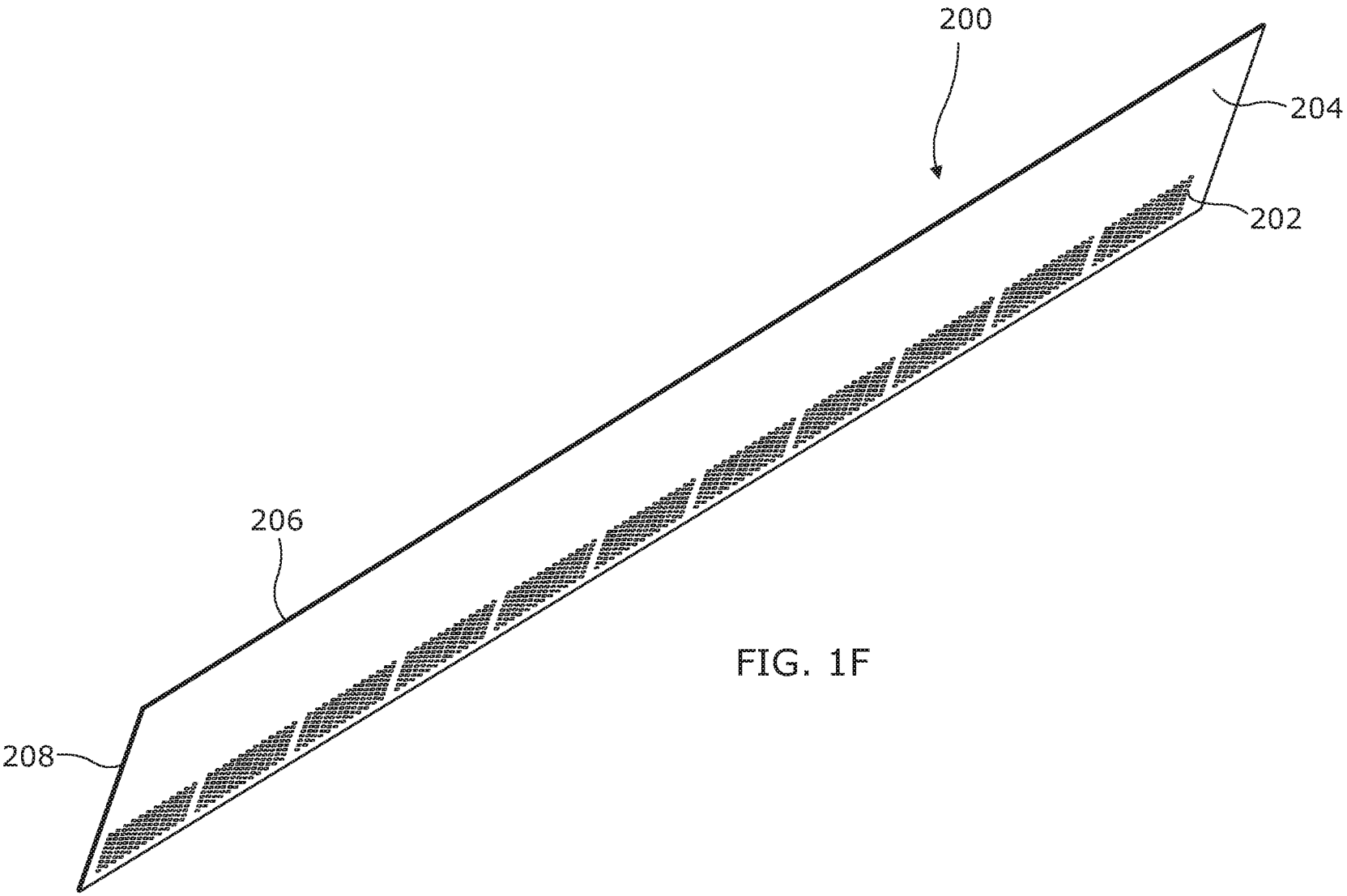
FIG. 1F is a bottom side perspective view of the vented fiber cement article of FIG. 1E.

Referring now to FIGS. 1E and 1F, there is shown a further embodiment of vented fiber cement article 200. Vented fiber cement article 200 is similar to vented fiber cement article 100 however vented area 202 has a grid pattern in the form of an interrupted pattern wherein non-vented portions 214 are positioned intermediate adjacent groups 212*a*, 212*b*, 212*c*, etc. of columns 202*a* and rows 202*b*. The angle arrangement and size configuration of apertures 210 within each adjacent group 212*a*, 212*b*, and so forth may correspond to any of the angle arrangement and size configurations of apertures 110 of vented fiber cement article 100.

Figure 2A:
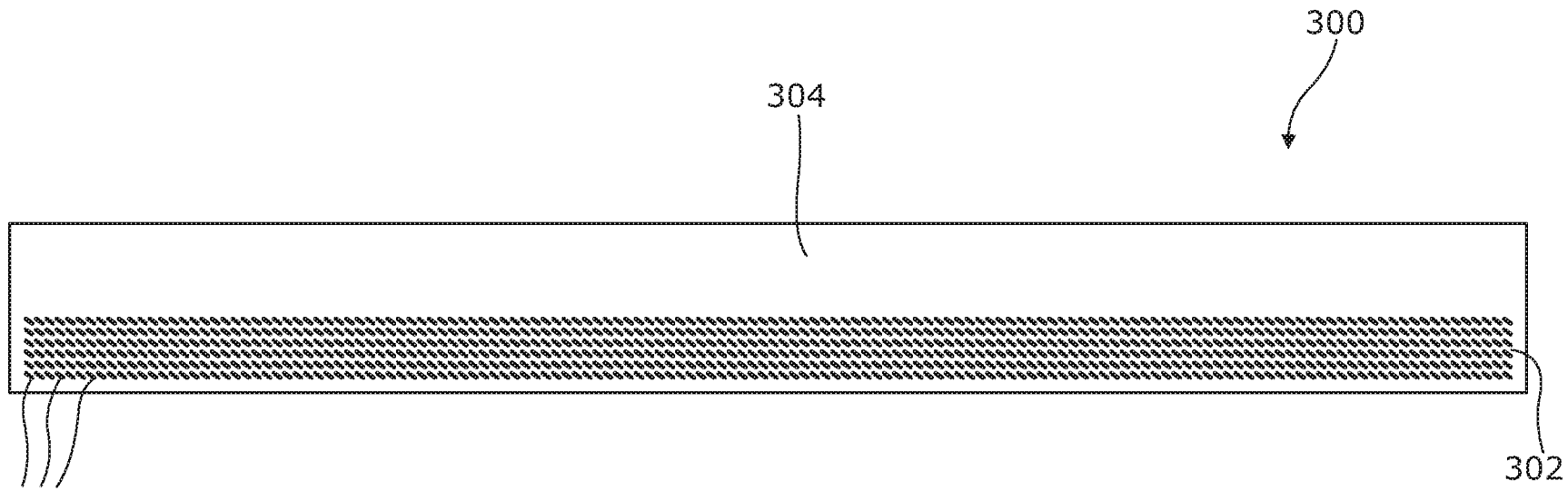
FIG. 2A is a top view of an example embodiment of a vented fiber cement article.
Figure 2B:
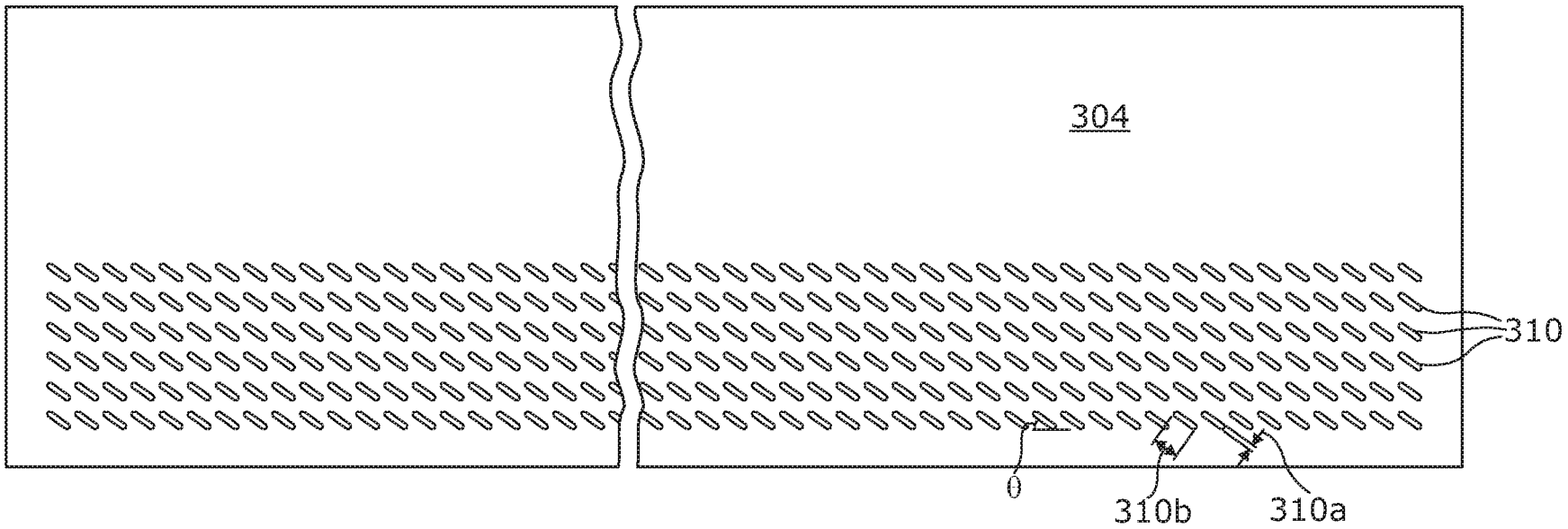
FIG. 2B is an enlarged top view of the aperture pattern of the vented fiber cement article of FIG. 2A.
Figure 2C:
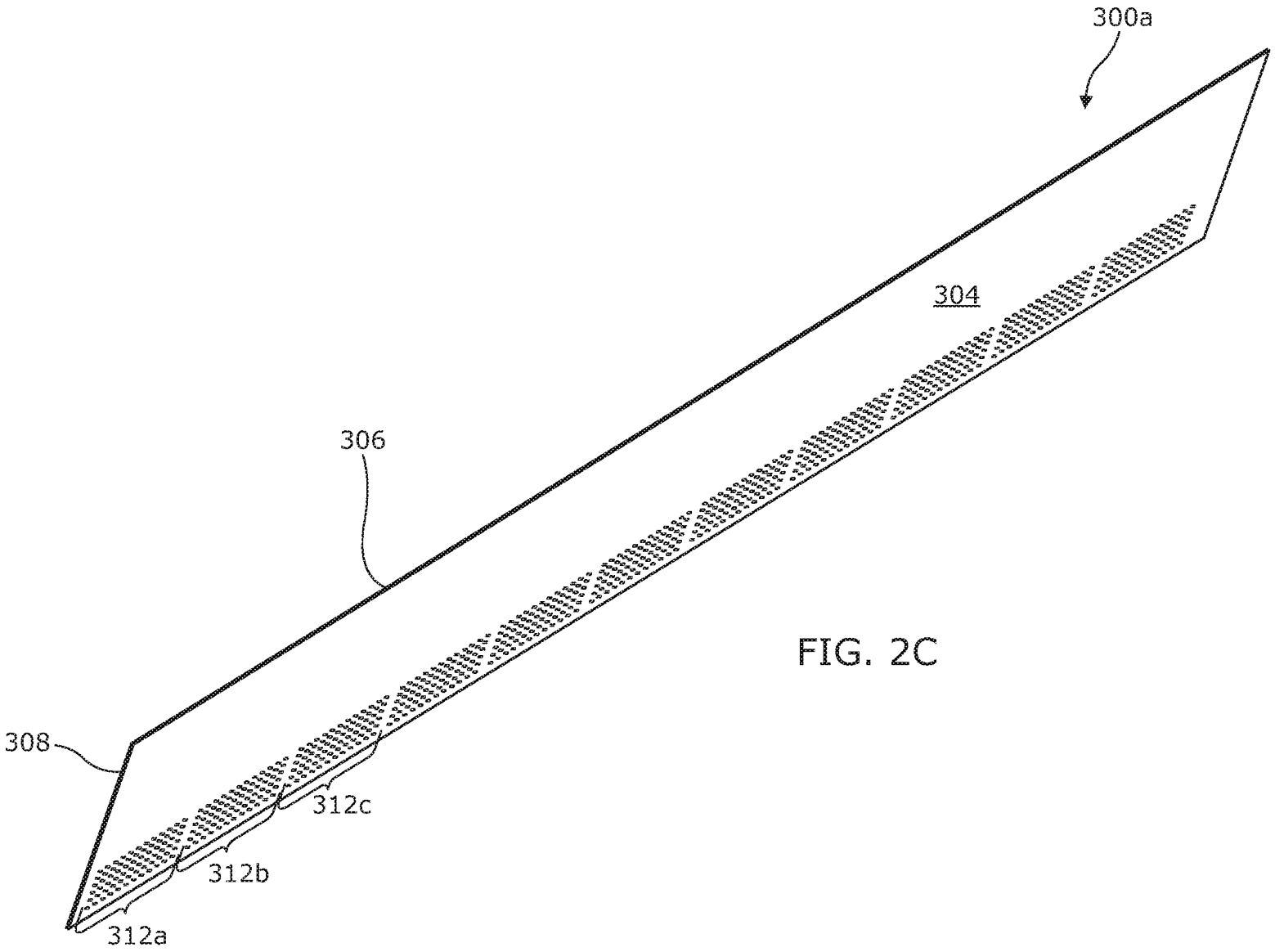
FIG. 2C is a perspective view of an alternative example embodiment of the vented fiber cement article of FIG. 2A.

Referring now to FIGS. 2A to 2C, there is shown another example embodiment vented fiber cement article 300 in which vented area 302 has a continuous grid pattern in FIGS. 2A and 2B; and example embodiment vented fiber cement article 300*a* in which vented area 302 has an interrupted grid pattern in FIG. 2C.

Vented fiber cement articles 300, 300*a* each comprise a first major face 304 and a second major face 306 opposing first major face 304. As before, an intermediate portion (not shown) is positioned between the first and second faces together with an edge portion 308 surrounding the intermediate portion such that the first and second major faces 304, 306, intermediate portion and edge portion 308 together form a panel of predetermined thickness. In one embodiment, the intermediate portion and edge portion 308 are integrally formed with the first and second major faces 304, 306 of the vented fiber cement article to form a solid panel.

Apertures 310 of vented fiber cement articles 300 and 300*a* are also in the form an obround cylindrical aperture, wherein the length of the first axis 310*a* of each aperture of the vented fiber cement article 300, 300*a* is approximately 0.17" (0.43 cm)±10% and the length of the second axis 310*b* of each aperture of the vented fiber cement article is approximately 0.85" (2.16 cm)±10%. In each of example embodiment vented fiber cement articles 300, 300*a*, the grid pattern comprises a series of six rows and twelve columns per linear foot. Apertures 310 of vented fiber cement articles 300 and 300*a* are also arranged such that the second axis of each aperture is positioned at an angle θ relative to the longitudinal axis of the vented fiber cement article 300 300*a*. In the example embodiment shown, the angle θ of the second axis relative to the longitudinal axis of the vented fiber cement article is approximately 33°±5°. In various embodiments, the angle θ can be, for example, between 15° and 45°, between 25° and 40°, between 30° and 35°, between 32° and 34°, or another suitable angle. In some embodiments, an individual vented article may include rows or columns having a different angle θ relative to other rows or columns of the article.

In the example vented fiber cement article 300 shown, the plurality of apertures 310 comprises approximately 72 apertures per linear foot. The net free ventilation achieved for this example embodiment is approximately 10 square inches per linear foot. When the plurality of apertures comprises approximately 72 apertures per linear foot the plurality of apertures comprises approximately 9.56% of the total surface area of the vented portion per linear foot.

Figure 3A:
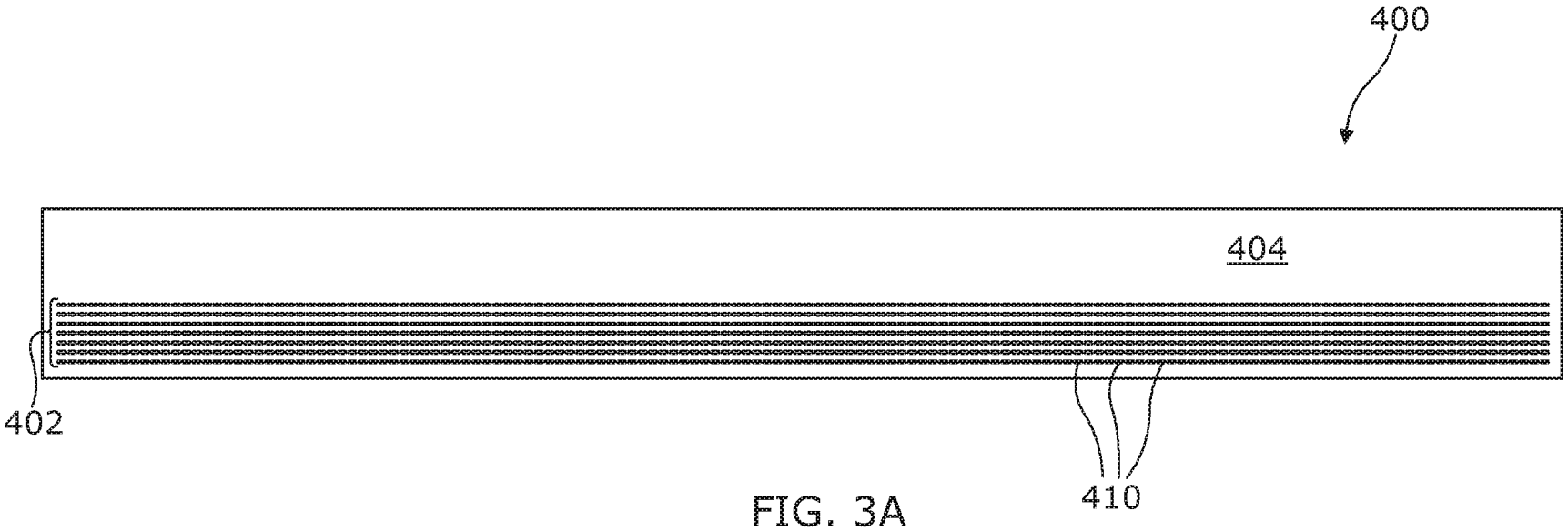
FIG. 3A is a top view of an example embodiment of a vented fiber cement article.
Figure 3B:
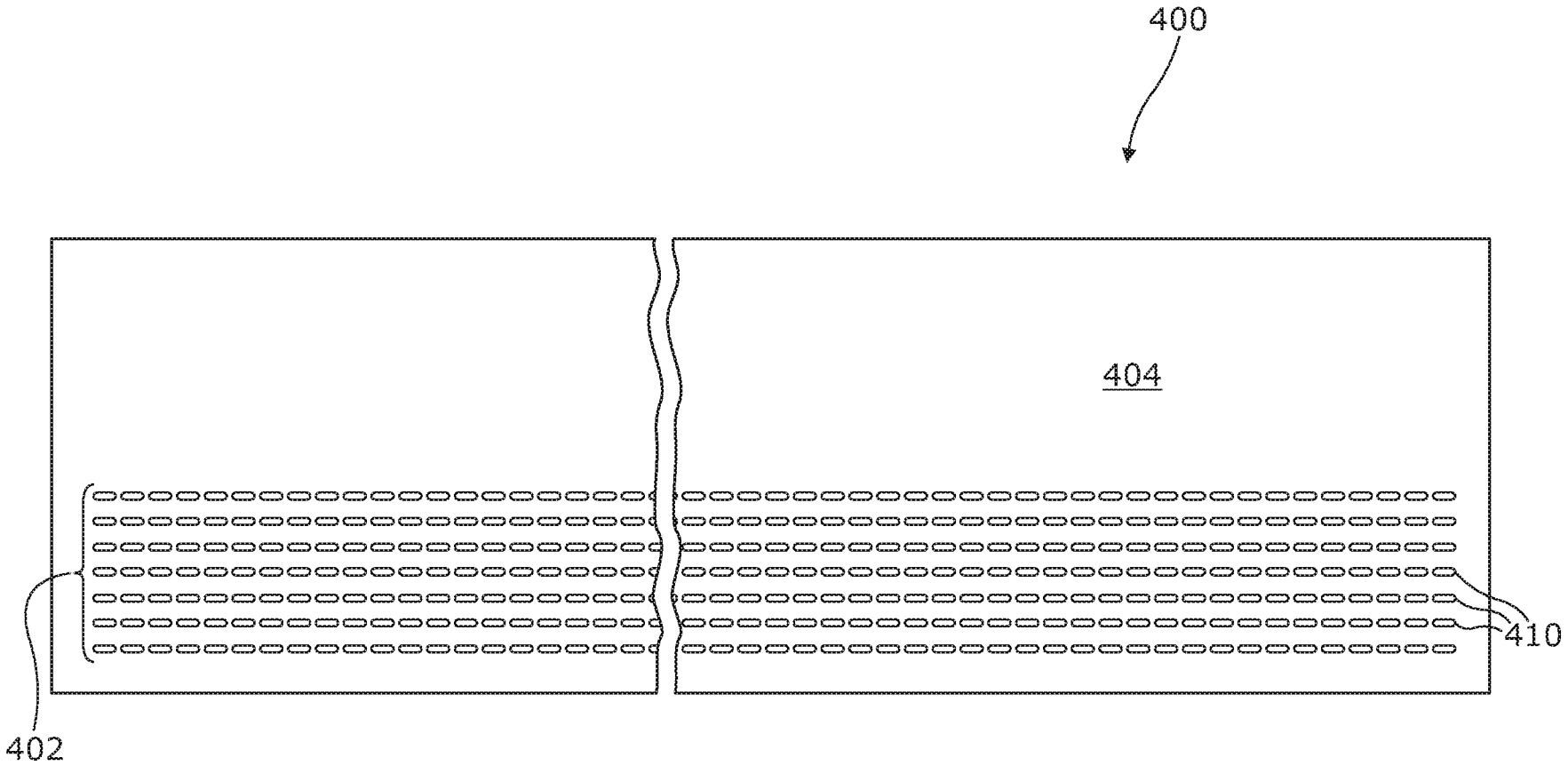
FIG. 3B is an enlarged top view of the aperture pattern of the vented fiber cement article of FIG. 3A.
Figure 3C:
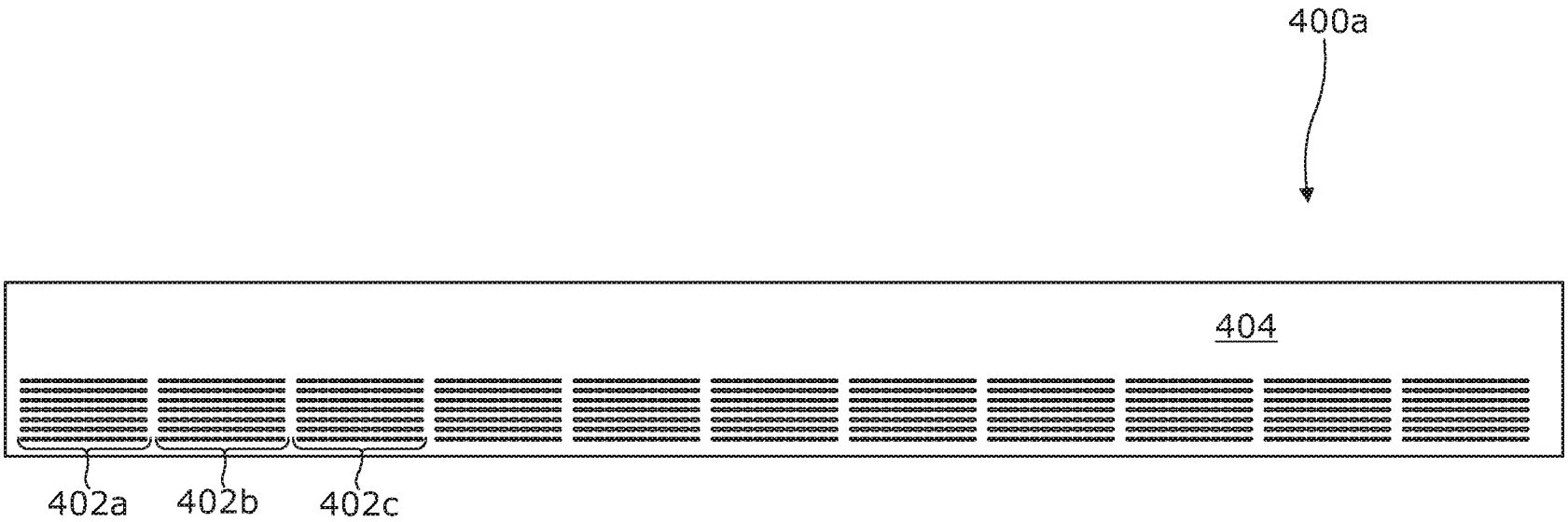
FIG. 3C is a top view of an alternative example embodiment of the vented fiber cement article of FIG. 3A.

Similarly in FIGS. 3A to 3C, there are shown further example embodiments of a vented fiber cement article in which the grid pattern of vented fiber cement article 400 is shown as a continuous grid pattern in FIGS. 3A and 3B; and example embodiment vented fiber cement article 400*a* in which the grid pattern is shown as an interrupted grid pattern in FIG. 3C. The size configuration of apertures 410 corresponds to those of vented fiber cement articles 100 and 200 however in each of example embodiment vented fiber cement articles 400, 400*a* apertures 410 are arranged such that the second axis of each aperture is positioned in parallel with the longitudinal axis of the vented fiber cement article 400 400*a*. In the example embodiment shown, the angle θ of the second axis relative to the longitudinal axis of the vented fiber cement article is approximately 0°.

In the example vented fiber cement article 400 shown, the plurality of apertures 410 comprises approximately 77 apertures per linear foot. The net free ventilation achieved for this example embodiment is approximately 11 square inches per linear foot. When the plurality of apertures comprises approximately 77 apertures per linear foot the plurality of apertures comprises approximately 10.33% of the total surface area of the vented portion per linear foot.

Figure 4A:
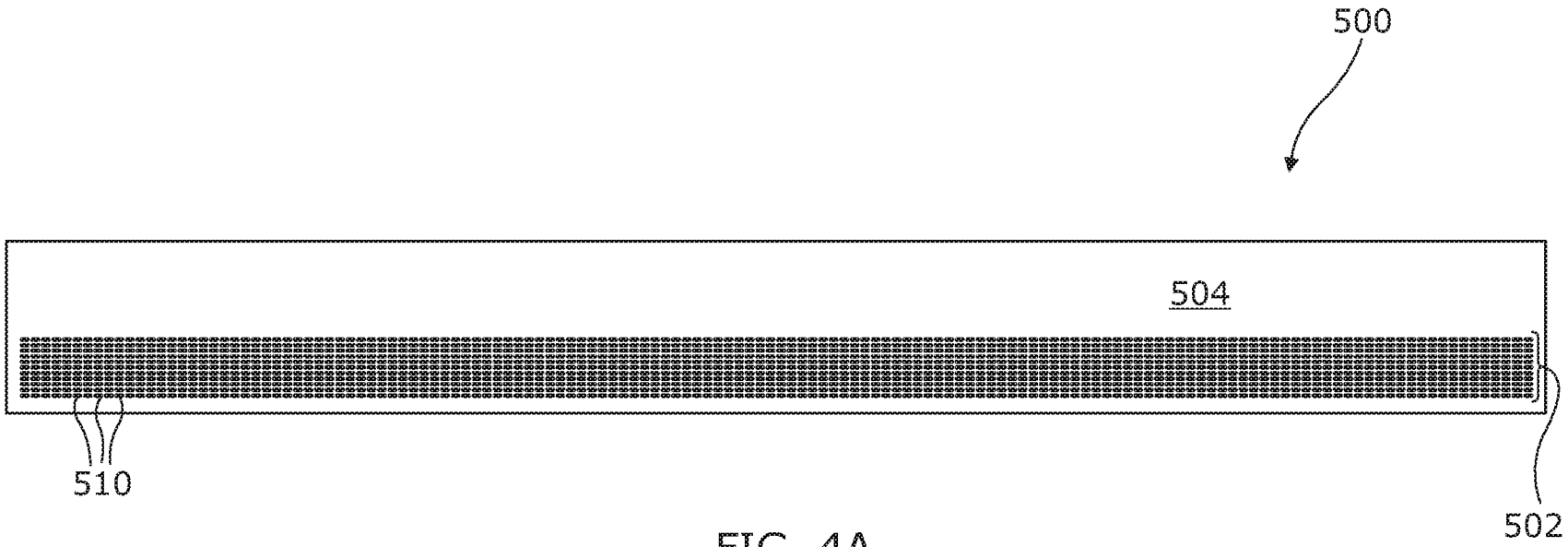
FIG. 4A is a top view of an example embodiment of a vented fiber cement article.
Figure 4B:
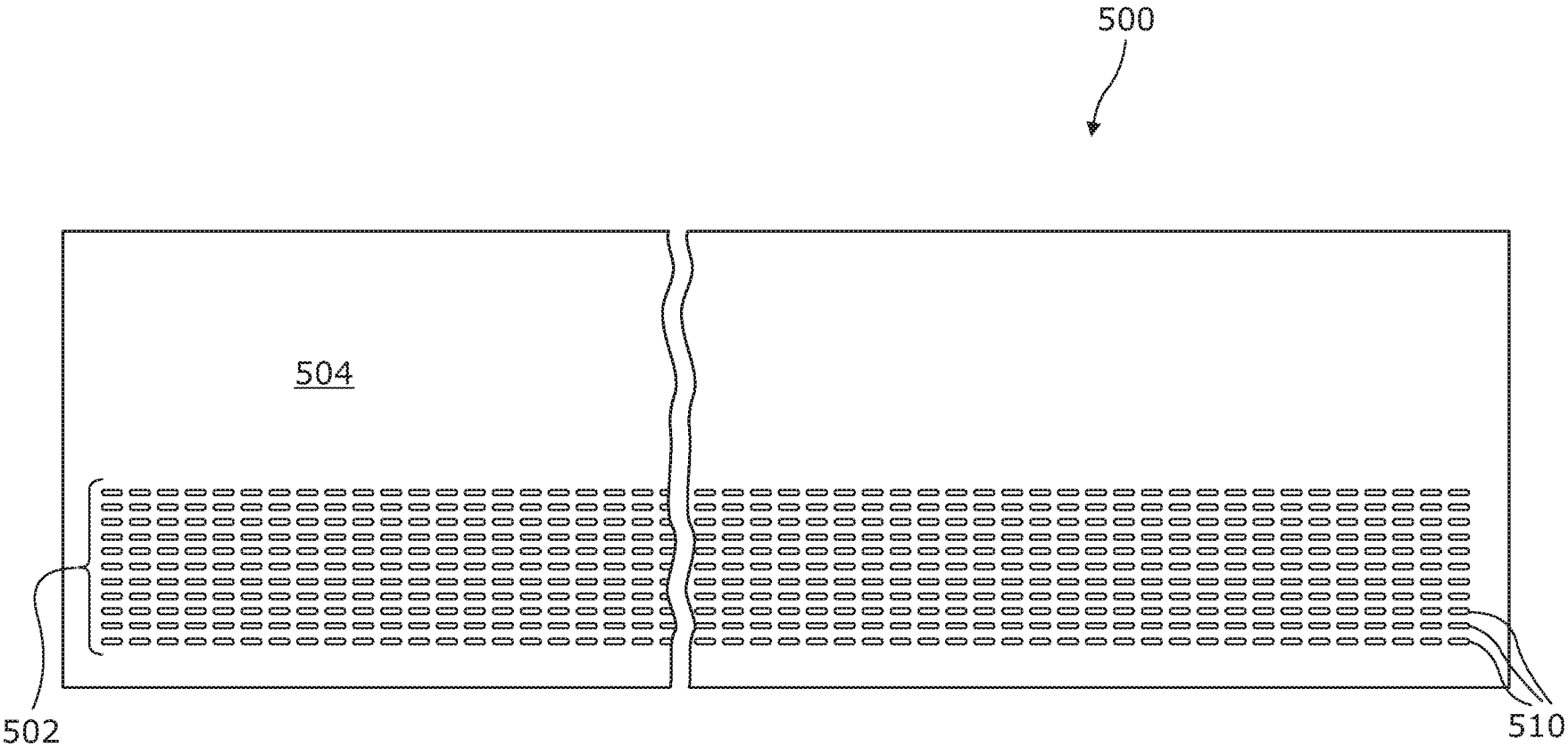
FIG. 4B is an enlarged top view of the aperture pattern of the vented fiber cement article of FIG. 4A.
Figure 4C:
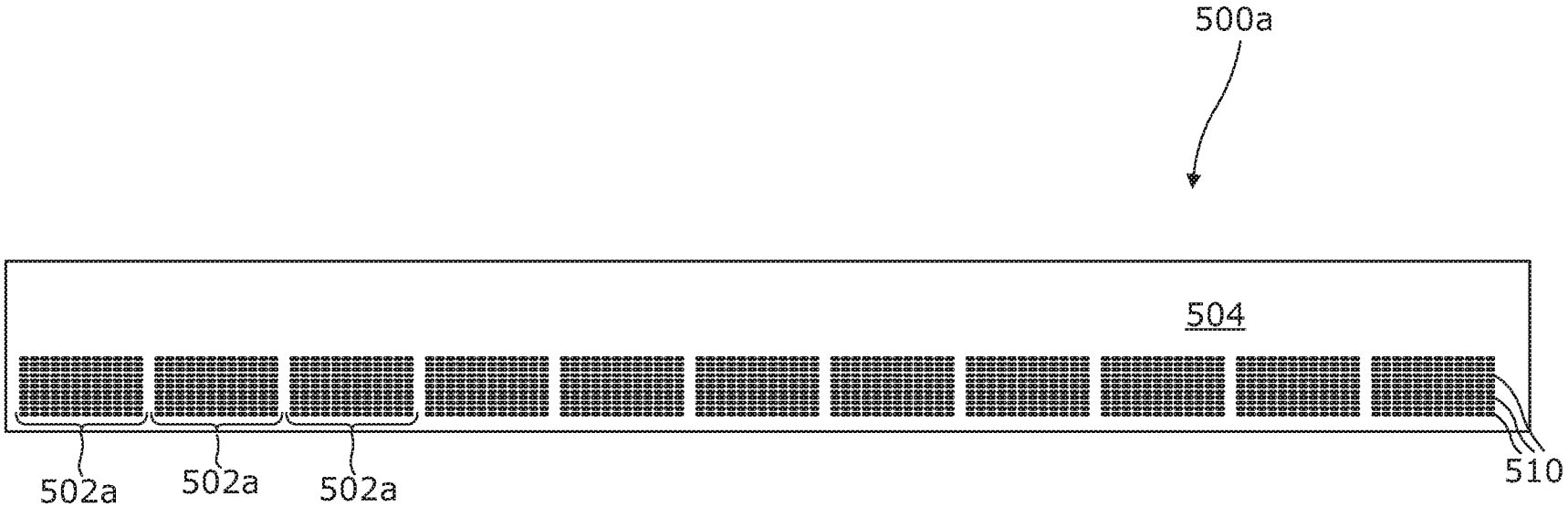
FIG. 4C is a top view of an alternative example embodiment of the vented fiber cement article of FIG. 4A.

Similarly in FIGS. 4A to 4C, there are shown further example embodiments of a vented fiber cement article in which the grid pattern of vented fiber cement article 500 is shown as a continuous grid pattern in FIGS. 4A and 4B; and example embodiment vented fiber cement article 500*a* in which the grid pattern is shown as a interrupted grid pattern in FIG. 4C. The length of the first axis of each aperture 510 of the vented fiber cement article 500, 500*a* is approximately 0.17" (0.43 cm)±10% and the length of the second axis of each aperture of the vented fiber cement article is approximately 0.776" (1.93 cm)±10%. Apertures 510 are arranged such that the second axis of each aperture is positioned in parallel with the longitudinal axis of the vented fiber cement article 500 500*a*.

In the example vented fiber cement article 500 shown, the plurality of apertures 510 comprises approximately 117 apertures per linear foot. The net free ventilation achieved for this example embodiment is approximately 15 square inches per linear foot. When the plurality of apertures comprises approximately 117 apertures per linear foot the plurality of apertures comprises approximately 14.16% of the total surface area of the vented portion per linear foot.

In one embodiment, each of the example embodiments of the vented fiber cement article 100, 200, 300, 300*a*, 400, 400*a*, 500 and 500*a* are designed to be used on the underside of eaves as soffit material. In some embodiments, each of the example embodiments of the vented fiber cement article are between 8 ft (2.4 m) and 16 ft (4.9 m) long. In one embodiment, the example embodiments of the vented fiber cement article are 8 ft (2.4 m) in length. In an alternative embodiment, the example embodiments of the vented fiber cement article are approximately 12 ft (3.7 m) in length. As described above, the vented fiber cement articles 100, 200, 300, 300*a*, 400, 400*a*, 500, 500*a* may have other lengths, such as 4 ft (1.2 m) or shorter, or intermediate lengths between 4 ft (1.2 m) and 16 ft (4.9 m) or longer.

In one embodiment, each of the example embodiments of the vented fiber cement article are between approximately 0.21" to 0.75" (5.5 mm to 19.1 mm) thick. In one particular exemplary embodiment the vented fiber cement article is between 0.23" to 0.26" (6.0 mm to 6.6 mm) thick and more preferably 0.25" (0.635 cm) thick.

In one embodiment, each of the example embodiments of the vented fiber cement article range between approximately 12" and 24" (30.48 cm and 60.96 cm) wide.

In certain embodiments, it is also possible to form the example embodiment vented fiber cement article as wide sheets in which the series of apertures are cut into the sheet in the desired grid pattern. The sheet is then cut into widths common to rake and eave applications as desired by the end user. This assists the end-user and reduces on site labour time and costs associated with cutting the vented fiber cement article when being used as soffit panels.

In further embodiments, example embodiment vented fiber cement article are pre-coated.

Each of the vented fiber cement articles exemplified in FIGS. 1A to 4C together with other exemplary embodiments as outlined in TABLE ONE below, were formed as fiber cement vented fiber cement article using the hatschek process. In one embodiment, each of example vented fiber cement articles 100, 200, 300, 400, 500 are provided as a vented fiber cement panel. The apertures of the fiber cement vented fiber cement article 100, 200, 300, 400, and 500 are formed in the fiber cement panels during the fiber cement panel manufacturing process. In one embodiment, the apertures are formed in the fiber cement panels by punching or any other suitable method known to the person skilled in the art.

The Net Free Ventilation (square inches per linear foot) was determined for each sample as shown in TABLE ONE below. The Net Free Ventilation (square inches per linear foot) ranges between 10 and 16 square inches per linear foot. It is desirable when forming a vented fiber cement article by inserting a plurality of apertures in a pattern arrangement within a fiber cement panel that the structural integrity of the fiber cement matrix of the fiber cement material is retained.

A Modulus of Rupture (MOR) test was conducted on the fiber cement vented fiber cement article to determine the flexural strength of the panel. The MOR test was carried out on a number of 6" (15.24 cm) by 13" (33.02 cm) samples. Each sample tested was a fiber cement article having a material composition including between approximately 50 wt % and approximately 68 wt % of silica, between approximately 24 wt % and approximately 36 wt % of cement, between approximately 6 wt % and 9 wt % of cellulose fibers, and between approximately 2 wt % and approximately 5 wt % of alumina. The sample size for each of the tested designs was eight. MOR was measured using a standard three point bend test with a 12" (30.48 cm) span. The average MOR (MPa) for the samples as outlined below in TABLE ONE below, wherein the plurality of apertures comprise between 11% and 19% per linear foot of the vented fiber cement article, ranges between 6.47 to 8.14 M Pa.

TABLE ONE

| DESIGN SAMPLE | EXAMPLE EMBODIMENT | WIDTH"/ (cm) | LENGTH"/ (cm) | SLOT ANGLE θ° | NUMBER OF ROWS | % AREA OF APERTURES IN VENTED PORTION PER LINEAR FOOT | AVERAGE MOR (MPA) | NET FREE VENTILATION (NFV)/PER LINEAR FOOT. |
|---|---|---|---|---|---|---|---|---|
| Control | — | 0.19" (0.48 cm) | — | — | 15-Offset | — | — | 5 |
| 1 | 100 | 0.19" (0.48 cm) | 0.776" (1.97 cm) | 33 | 9 | 14.48 | 6.47 | 15 |
| 2 | — | 0.17" (0.43 cm) | 0.73" (1.85 cm) | 33 | 9 | 12.11 | — | 13 |
| 3 | — | 0.17" (0.43 cm) | 0.776" (1.97 cm) | 33 | 9 | 13.04 | — | 14 |
| 4 | 300 | 0.17" (0.43 cm) | 0.85" (2.16 cm) | 33 | 6 | 9.56 | 8.14 | 10 |
| 5 | — | 0.17" (0.43 cm) | 0.81" (2.05 cm) | 33 | 8 | 12.23 | — | 13 |
| 6 | 400 | 0.19" (0.48 cm) | 0.776" (1.97 cm) | 0 | 7 | 10.33 | 7.86 | 11 |
| 7 | 500 | 0.17" (0.43 cm) | 0.776" (1.97 cm) | 0 | 11 | 14.16 | 7.08 | 15 |
| 8 | — | 0.17" (0.43 cm) | 0.75" (1.91 cm) | 0 | 11 | 15.37 | | 16 |

Generally described and with reference to FIG. 5A to 5D, there is shown an installation of example embodiment of the vented fiber cement article 100, (hereinafter referred to as a vented fiber cement article 100) on the exposed exterior under surface 800 of an overhanging section of roof 600. For clarity, certain components normally found in a roof structure, including the roof sheathing, underlayment and shingles, are not shown in FIG. 5A to 5D. Although the soffit panel depicted in FIG. 5A to 5D is consistent with the vented fiber cement article 100 depicted in FIG. 1A to 1D, it will be appreciated that any of the fiber cement articles 100, 200, 300, 300*a*, 400, 400*a*, 500, 500*a* may be installed in the same configuration.

Figure 5A:
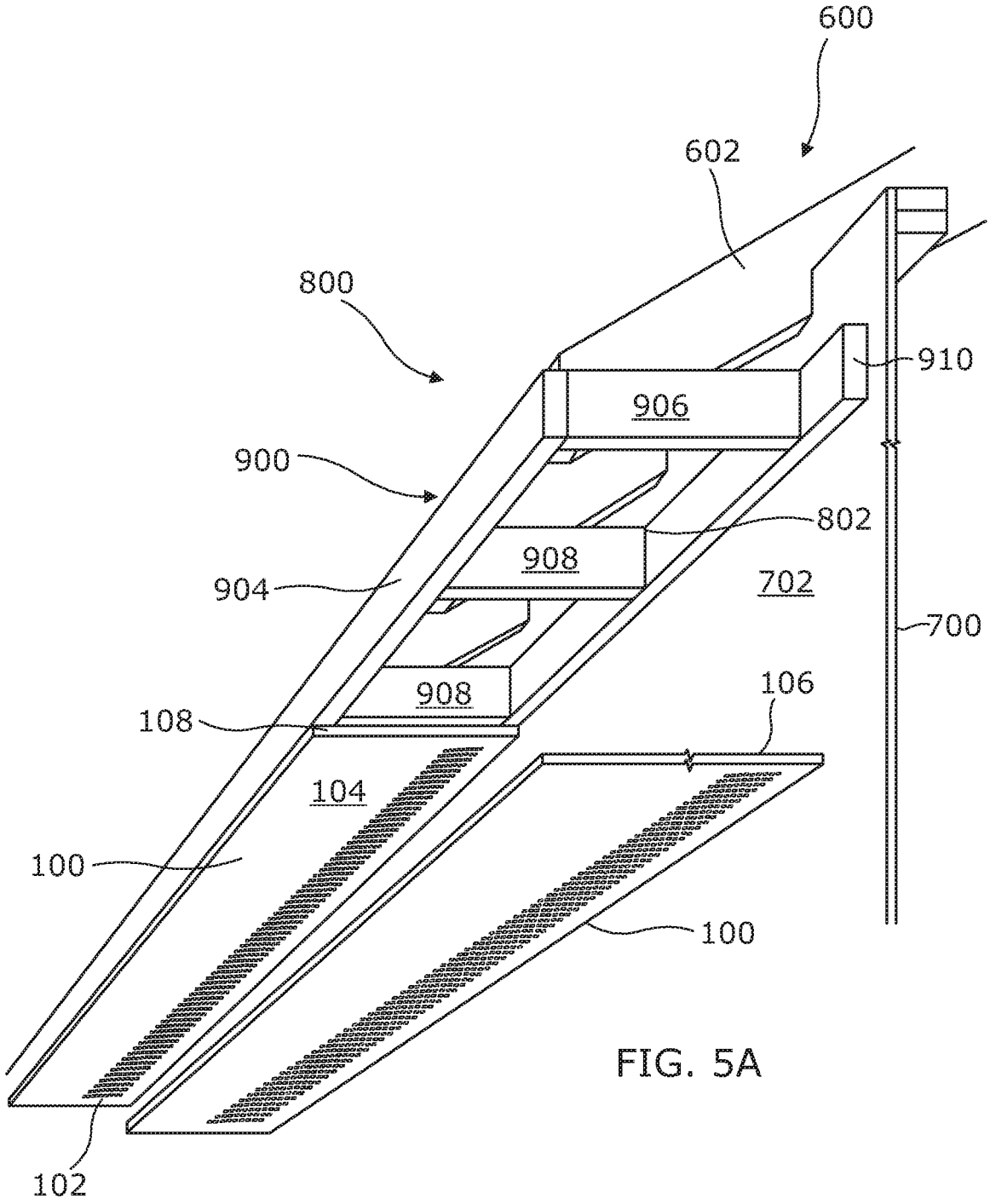
FIG. 5A is a perspective view of the example embodiment vented fiber cement article of FIG. 1A being applied to the exposed exterior under surface of an overhanging section of a roof.
Figure 5B:
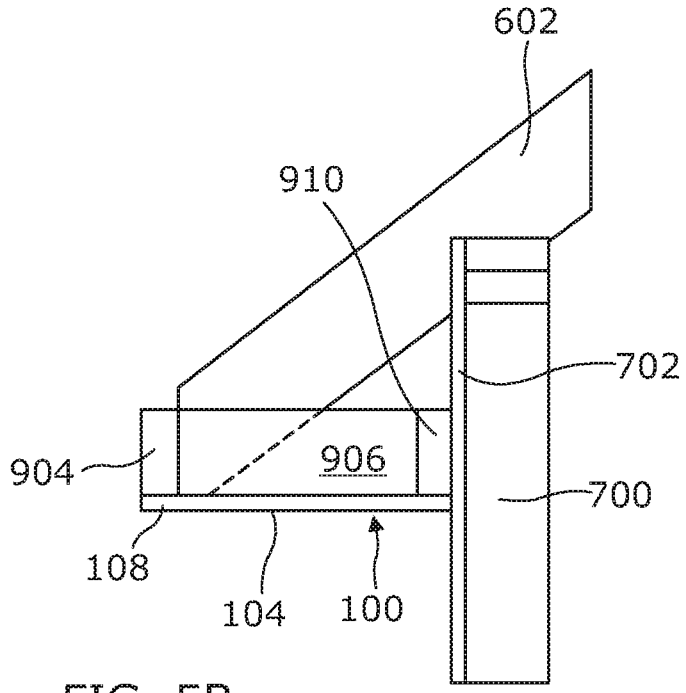
FIG. 5B is an end side view of the vented fiber cement article of FIG. 1A once applied to the exposed exterior under surface of an overhanging section of a roof shown in FIG. 5A.

Referring to FIG. 5A, the rafters 602 of roof structure 600 are shown extending over building substrate 700 and connecting to the eave framing structure 900 to form the overhanging section 800 of roof 600. Eave framing structure 900 comprises a subfascia 904 connected to ledger board 910 via blocking members 906. In the embodiment shown in FIGS. 5A and 5B, ledger board 910 is attached to building substrate 700 which has been covered with a breathable waterproof membrane, such as for example, a building or house wrap 702. Further intermediate support members 908 are provided as desired along the eave framing structure 900. The components of the eave framing structure 900 are visible in the exposed exterior under surface 802 of the overhanging section of roof 600.

As will be described in greater detail below, example embodiment vented fiber cement article 100 is secured to the eave framing structure 900 using appropriate fasteners, such as for example, nails to cover the exposed exterior under surface 802 of the overhanging section of roof 600. It is also possible to use alternate mechanical or chemical fasteners to secure the example embodiment vented fiber cement article 100 to the eave framing structure 900, if so desired.

When securing the example embodiment vented fiber cement article 100 to the eave framing structure, the example embodiment vented fiber cement article 100 is positioned on the eave framing structure such that the longitudinal axis of the example embodiment vented fiber cement article 100 is parallel to the longitudinal axis of the ledger board 910 and subfascia 904 as shown in FIG. 5A. In this way the external face 104 of the example embodiment vented fiber cement article 100 forms the external surface of the overhanging section of roof 600. Further example embodiment vented fiber cement articles 100 are placed adjacent to edge portion 108 on the remaining exposed eave framing structure 900 until the eave framing structure 900 is covered as desired by the end user.

Figure 5C:
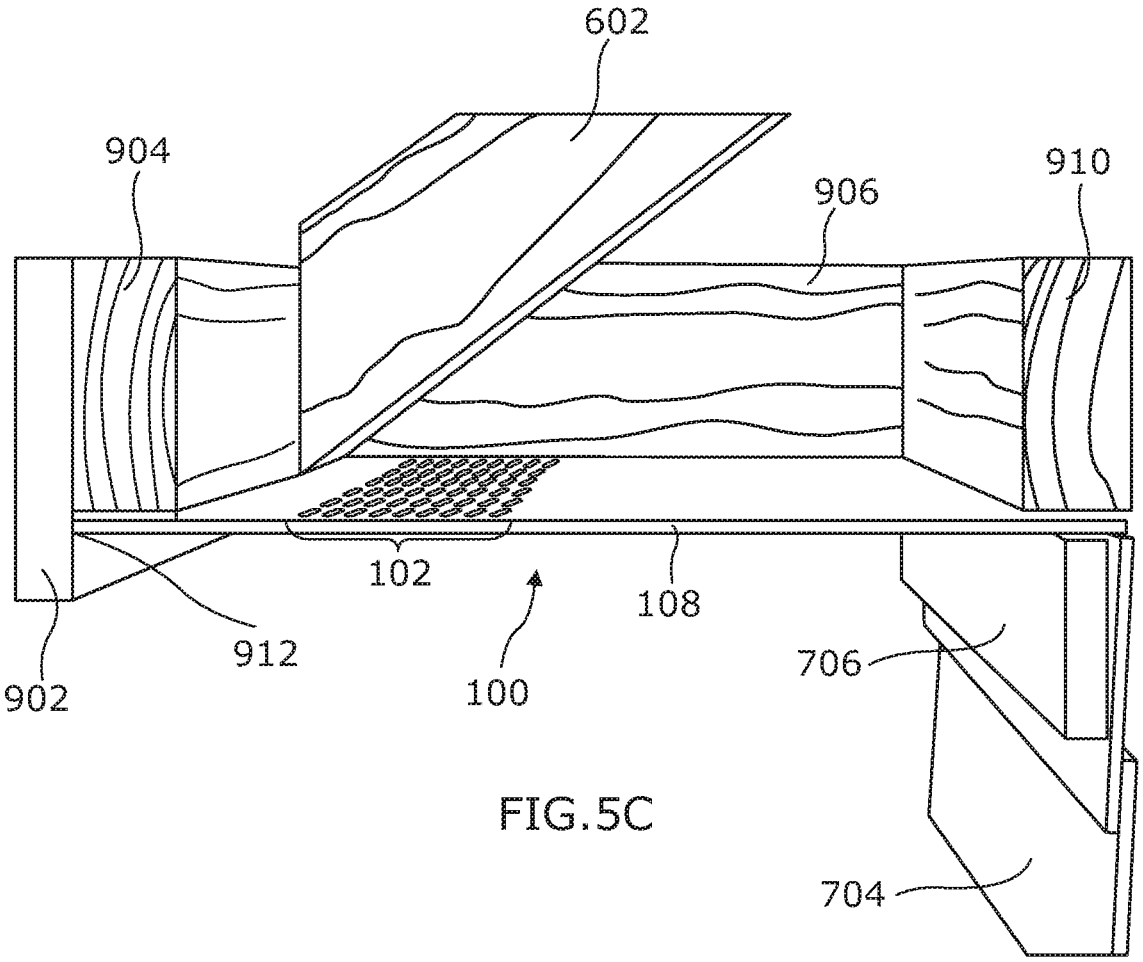
FIG. 5C is a sectional side perspective view of the vented fiber cement article of FIG. 1A once applied to the exposed exterior under surface of an overhanging section of a roof shown in FIG. 5A.

In the embodiment shown, vented fiber cement article 100 has been placed on the eave framing structure such that vented portion 102 is shown in close proximity to building substrate 700. It should be understood that in an alternative embodiment vented fiber cement article 100 can also be placed on the eave framing structure such that vented portion 102 is remote from building substrate 700. It is preferable to place the vented fiber cement article 100 on the eave framing structure to maximise flow of air, laminar or otherwise through the apertures into the attic space. It is often more preferable to position the vented portion 102 of each of the example embodiment vented soffit panels toward the outside edge 912 of the eave framing structure 900, wherein the outside edge 912 of the eave framing structure is adjacent the junction between the fascia 902 and subfascia 904 (as shown in FIG. 5C). This is to facilitate natural continuous air flow through the apertures 110 of the example embodiment vented fiber cement article 100 into, through, and out of the attic space.

Figure 5D:
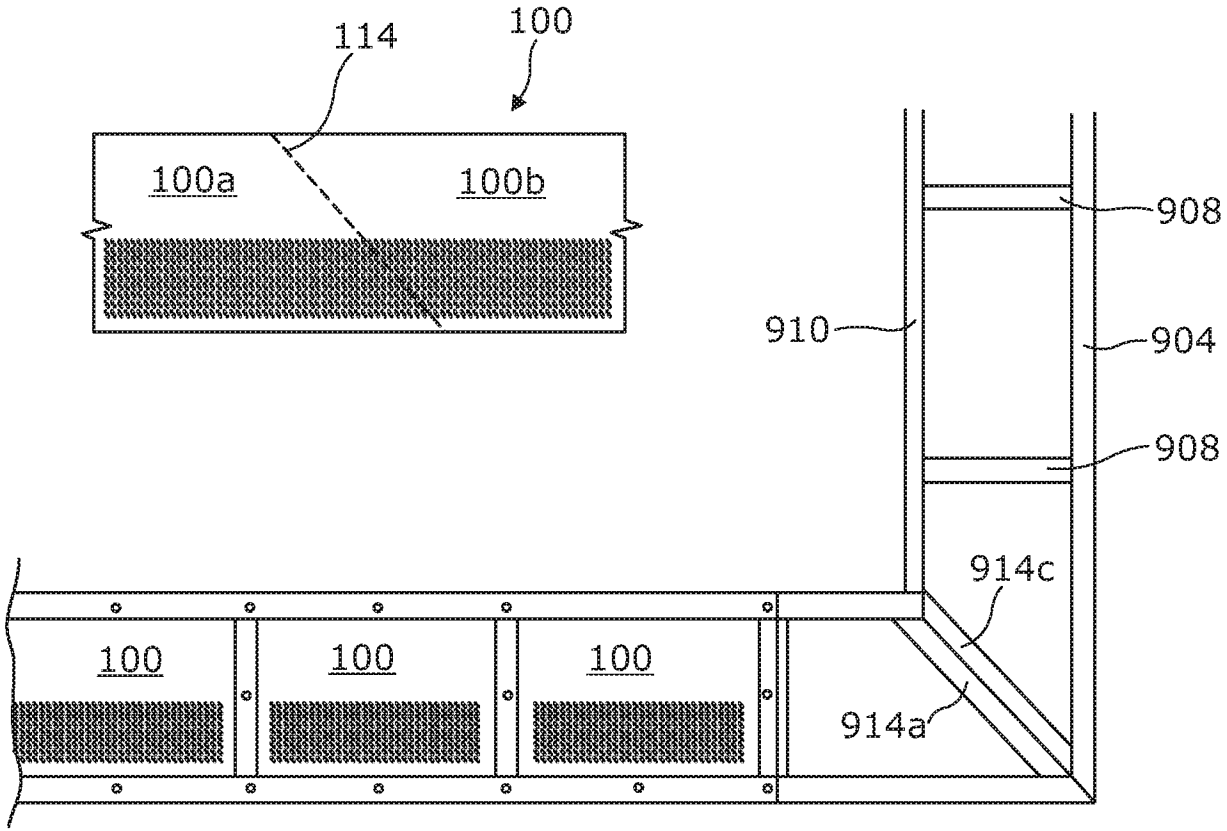
FIG. 5D is a bottom view of the example embodiment vented fiber cement article of FIG. 1A being applied to the exposed exterior under surface of an overhanging section of a roof at a corner section.

It is also possible to cut the example embodiment vented fiber cement article 100 to form an angular vented fiber cement article 100*a*, 100*b* as shown in FIG. 5D. Conveniently the example embodiment vented fiber cement article 100 is cut along cut line 114 to form angular vented fiber cement article 100*a*, 100*b* that complements the angle formed by the corner framing members 914*a* and 914*c* within the eave framing structure 900. A first angular vented fiber cement article 100*a* or 100*b* (as appropriate) is secured to the eave framing structure 900 such that the cut line 114 is positioned over and secured to the first corner framing member 914*a*. A second angular vented fiber cement article 100*a* or 100*b* (as appropriate) is then cut as needed and secured to the second corner framing member 914*c* to cover the opposing side of the corner section thereby completely covering the corner section with the example embodiment vented fiber cement article 100.

In practice, when using example embodiment vented fiber cement articles 100 to cover the exposed exterior under surface 802 of the overhanging section of roof 600, adjacent example embodiment vented fiber cement articles 100 may be brought into contact with each other or alternately where a gap is formed, the gap may be covered to seal the exterior under surface 802. In certain embodiments the gap formed between adjacent example embodiment vented fiber cement articles 100 could be sealed using a filler, for example, caulk; using a connector, for example, a PVC or metal H molding; or alternatively using a cover, for example a batten.

Once the vented fiber cement article 100 is positioned on the eave framing structure the external surface of building is finished as desired by the end user. In the embodiment shown in FIG. 5C, siding 704 has been installed over the breathable waterproof membrane (no longer shown) and a frieze board 706 is shown covering the junction between the siding 704 and the example embodiment vented fiber cement article 100. It is of course understood that there are several other options to finish the junction between siding 704 and example embodiment vented fiber cement article 100, for example, it is possible to caulk the junction between siding 704 and example embodiment vented fiber cement article 100. Alternatively it is possible to cover the junction between siding 704 and example embodiment vented fiber cement article 100 using crown molding. It is also possible to cover the top edge of the siding with a J channel such that the base of the J channel abuts the example embodiment vented fiber cement article 100.

In further embodiments, each of alternate example embodiments of the vented fiber cement article 300, 300*a*, 400, 400*a*, 500 and 500*a* as described with reference to FIGS. 2A to 4*d*, are installed on the exposed exterior under surface of an overhanging section of a roof 600 in a similar manner.

In a further embodiment, it is possible to provide additional insect protection in the form of a screen or mesh on each of the example embodiments of the vented fiber cement article 100, 200, 300, 300*a*, 400, 400*a*, 500 and 500*a*. It is preferable to place the additional insect protection on the side 106, 206, 306, 406, 506 of the example embodiment vented fiber cement article 100, 200, 300, 300*a*, 400, 400*a*, 500 and 500*a* adjacent the eave framing structure 900 (FIG. 5A) which is not going to be exposed in use. The additional insect protection covers at least the vented portion 102, 202, 302, 402, 502 of each of the example embodiments of vented fiber cement article 100, 200, 300, 300*a*, 400, 400*a*, 500 and 500*a*. Optionally, it is also possible for the additional insect protection to extend beyond vented portions 102, 202, 302, 402, 502 such that the non-vented portion of the vented fiber cement article 100, 200, 300, 300*a*, 400, 400*a*, 500 and 500*a* is partially or completely covered by the additional insect protection. For example, in one embodiment the additional insect protection extends approximately 1 to 2" (2.54 cm to 5.08 cm) beyond the vented portions 102, 202, 302, 402, 502 such that the additional insect protection partially covers approximately 1 to 2" (2.54 cm to 5.08 cm) of the non-vented portion of the vented fiber cement article 100, 200, 300, 300*a*, 400, 400*a*, 500 and 500*a*.

Wind load testing was conducted in accordance with ASTM E330 using Design Sample 4. Design Sample 4 was compared to a control vented fiber cement article comprising a plurality of circular apertures having a diameter of 0.19" (0.48 cm) and a Net Free Ventilation of 5 square inches per linear foot. Both the control and vented fiber cement article design sample 4 were secured for testing using a 6 d nail at 4" on centre fastening.

TABLE TWO

| DESIGN SAMPLE | EX-AMPLE | WIDTH "/(cm) | LENGTH "/(cm) | NET FREE VENTI-LATION (NFV)/ PER LINEAR FOOT. | WIND LOAD TESTING/ psf |
|---|---|---|---|---|---|
| Control | — | 0.19" (0.48 cm) | | 5 | 162.09 |
| 4 | | 0.17" (0.43 cm) | 0.776" (1.97 cm) | 13.58 | 144.3 |

It will of course be understood that the invention is not limited to the specific details described herein, which are given by way of example only, and that various modifications and alterations are possible within the scope of the disclosure as defined in the appended claims.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as 'can', 'could', 'might', or 'may', unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase 'at least one of X, Y, and Z' unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with ventilation systems used to provide ventilation to roof and attic spaces of buildings, and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practised using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A soffit assembly for a building structure with an attic space, comprising:

a fiber cement soffit panel configured to couple to an underside of an eave framing structure extending outward relative to the building structure and comprising a plurality of framing members defining any airflow path in fluid communication with the attic space, the fiber cement soffit panel comprising:

a substantially planar first major face;

a substantially planar second major face;

an intermediate portion positioned between the first and second major faces; and a plurality of integrally formed cylindrical apertures extending through the intermediate portion from the first major face to the second major face to permit airflow between an exterior volume and the airflow path, each of the cylindrical apertures having an obround cross section defined by a first axis and a second axis perpendicular to the first axis, the second axis being longer than the first axis and oriented at an angle of between approximately 25° and approximately 40° relative to a machine direction of the fiber cement soffit panel such that opposing ends of the cylindrical apertures are offset from each other, the apertures being arranged in a grid pattern generally defining a ventilated area of the fiber cement soffit panel, the cylindrical apertures comprising between approximately 9% and approximately 15.5% of the total surface area of the ventilated area, wherein the fiber cement soffit panel further comprises one or more non-ventilated fastening areas disposed along an edge of the fiber cement soffit panel, and wherein a plurality of mechanical fasteners extend through one of the one or more fastening areas and into one of the plurality of framing members to fix the fiber cement soffit panel to the eave framing structure; and wherein the composition of the fiber cement soffit panel comprises between 50 wt % and 68 wt % silica, between 24 wt % and 36 wt % cement, between 6 wt % and 9 wt % cellulose fibers, and between 2 wt % and 5 wt % alumina, and wherein the fiber cement soffit panel has a net free ventilation between 10 and 16 square inches per linear foot and maintains an average modulus of rupture per linear foot of between approximately 6.4 MPa and 8.2 MPa.

2. The soffit assembly of claim 1, wherein the ventilated area comprises a rectangular portion of the fiber cement soffit panel disposed distal from the building structure.

3. The soffit assembly of claim 1, wherein the ventilated area comprises a rectangular portion of the fiber cement soffit panel disposed proximal to the building structure.

4. The soffit assembly of claim 1, wherein the fiber cement soffit panel is divided longitudinally into two contiguous sections by a central longitudinal axis, wherein the cylindrical apertures are disposed on one of the two contiguous sections.

5. A fiber cement soffit assembly comprising;

a panel comprising a first major face, a second major face, and an intermediate portion positioned between the first and second major faces such that the first major face, the second major face, and the intermediate portion together form the panel; and a plurality of obround cylindrical apertures extending between the first and second major faces of the panel through the intermediate portion such that a vented portion is formed in the panel, each obround cylindrical aperture defined by a first axis and a second axis perpendicular to the first axis, the second axis being longer than the first axis;

wherein the plurality of apertures are provided in a series of columns and rows such that a grid pattern is formed, the rows of apertures being perpendicular to the columns of apertures within the grid pattern;

wherein each aperture within the grid pattern is oriented such that the second axis of each aperture is at an angle between 0° and 45° relative to the perpendicular axes of each column and row within the grid pattern; and wherein the surface area of the plurality of apertures comprises between approximately 9% and 15.5% of the total surface area of the vented portion per linear foot such that the net free ventilation of the vented fiber cement article is between 10 and 16 square inches per linear foot.

6. The fiber cement soffit assembly of claim 5, wherein the width of each aperture along the first axis is between approximately 0.17" (0.43 cm) and 0.19" (0.48 cm).

7. The fiber cement soffit assembly of claim 5, wherein the length of each aperture along the second axis is between approximately 0.73" (1.85 cm) and 0.85" (2.16 cm).

8. The fiber cement soffit assembly of claim 5, wherein the cross-sectional area of each aperture parallel to the first and second axes is between approximately 0.118 and 0.215 inches squared (0.76 $cm^2$ and 1.39 $cm^2$).

9. The fiber cement soffit assembly of claim 5, wherein the number of rows in the grid pattern is between 6 and 11 and the number of columns per linear foot of the grid pattern is between 6 and 12.

10. The fiber cement soffit assembly of claim 5, wherein the distance between the first and last row of apertures within a series of rows of the grid pattern is between approximately 4.68" (11.89 cm) and 5.68" (14.43 cm).

11. The fiber cement soffit assembly of claim 5, wherein the vented fiber cement article further comprises a fastening area which extends approximately 1.5" (3.81 cm) from the outermost tips of the first and last apertures in the series of rows and columns within the grid pattern.

12. The fiber cement soffit assembly of claim 11, wherein the vented portion extends between approximately 7.68" (19.51 cm) and 8.68" (22.05 cm) in a planar direction perpendicular to the direction of the series of columns in the grid pattern.

13. The fiber cement soffit assembly of claim 5, wherein the second axis of each aperture of the vented fiber cement article is at an angle of approximately 33° relative to the perpendicular axes of each column and row within the grid pattern.

14. The fiber cement soffit assembly of claim 5, wherein the total surface area of the vented portion per linear foot is between approximately 92 and 104 inches squared (0.059 $m^2$ and 0.067 $m^2$).

15. The fiber cement soffit assembly of claim 5, wherein the vented fiber cement article comprises between approximately 60 and 132 apertures per linear foot.

16. The fiber cement soffit assembly of claim 5, wherein the plurality of apertures comprises between approximately 12% and 12.5% the total surface area of the vented fiber cement article per linear foot.

17. The fiber cement soffit assembly of claim 5, wherein the average modulus of rupture per linear foot is between approximately 6.4 MPa and 8.2 MPa.

* * * * *